US006985599B2

(12) United States Patent
Åsnes

(10) Patent No.: US 6,985,599 B2
(45) Date of Patent: Jan. 10, 2006

(54) VIBRATOR FOR BONE CONDUCTED HEARING AIDS

(75) Inventor: Kristian Åsnes, Mölndal (SE)

(73) Assignee: P&B Research AB, Göteborg (SE)

( * ) Notice: Subject to any disclaimer, the term of this patent is extended or adjusted under 35 U.S.C. 154(b) by 0 days.

(21) Appl. No.: 10/296,980

(22) PCT Filed: May 31, 2001

(86) PCT No.: PCT/SE01/01228

§ 371 (c)(1),
(2), (4) Date: Jul. 30, 2003

(87) PCT Pub. No.: WO01/93634

PCT Pub. Date: Dec. 6, 2001

(65) Prior Publication Data

US 2004/0057588 A1 Mar. 25, 2004

(30) Foreign Application Priority Data

Jun. 2, 2000 (SE) ..... 0002072

(51) Int. Cl.
*H04R 25/00* (2006.01)

(52) U.S. Cl. ..... 381/326; 381/322; 381/412

(58) Field of Classification Search ..... 381/326, 381/380, 322, 412–415, 401, 396, 400, 406, 381/407, 417, 418, 420, 152; 600/25; 607/55, 607/56, 57

See application file for complete search history.

(56) References Cited

U.S. PATENT DOCUMENTS 905,781 A 1/1908 Baldwin
4,498,461 A 2/1985 Håkansson
4,606,329 A 8/1986 Hough
4,904,233 A 2/1990 Håkansson et al.
4,988,333 A 1/1991 Engelbretson et al.
5,282,858 A 2/1994 Bisch et al.
5,318,502 A 6/1994 Gilman
5,411,467 A 5/1995 Hortmann et al.
5,562,670 A 10/1996 Brånemark
5,812,598 A 9/1998 Sharma et al.
5,897,486 A 4/1999 Ball et al.
5,913,815 A 6/1999 Ball et al.
5,951,601 A 9/1999 Lesinski et al.
6,053,920 A 4/2000 Carlsson et al.
6,151,402 A * 11/2000 Azima et al. ..... 381/396
6,757,402 B2 * 6/2004 Chan ..... 381/396
2003/0034705 A1 2/2003 Håkansson

FOREIGN PATENT DOCUMENTS

WO 99/09785 2/1999
WO 00/10361 2/2000
WO 01/93635 12/2001

* cited by examiner

*Primary Examiner*—Huyen Le

(74) *Attorney, Agent, or Firm*—Venable LLP; Eric J. Franklin

(57) ABSTRACT

A vibrator for a bone conduction-type hearing aid device by which sound information is mechanically transmitted via the skull bone directly to the inner ear of a person with impaired hearing. The vibrator includes a coil that is directly into two coil halves for generating a dynamic magnetic field and a permanent magnet for generating a static magnetic field. The permanent magnet is radially magnetized and arranged in such a way that the static and dynamic magnetic fields coincide in air gaps formed between the coil and magnet arrangement and the casing, whereby the vibrator provides an axial force.

14 Claims, 4 Drawing Sheets

VIBRATOR FOR BONE CONDUCTED HEARING AIDS

FIELD OF THE INVENTION

The present invention relates to a vibrator for hearing aid devices of the bone conduction type, i e hearing aid devices by which the sound information is mechanically transmitted via the skull bone directly to the inner ear of a person with impaired hearing. The vibrator can be used for traditional, bone anchored as well as implanted bone conduction hearing aid devices.

BACKGROUND OF THE INVENTION

For persons with impaired hearing, the hearing aid devices which are mainly used today are those based on the principle that the sound is amplified and fed into the auditory meatus and stimulates the eardrum from the outside. In order to prevent feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal.

For persons who cannot benefit from traditional, air conduction hearing aids due to such problems that have been described here it is previously known to use hearing aids which leave the auditory meatus free, see for instance U.S. Pat. No. 5,411,467 and U.S. Pat. No. 5,318,502 which hearing aids are both connected to the middle ear. Such a connection, however, requires a surgical operation in the middle ear which is a relatively complicated procedure.

By U.S. Pat. No. 5,282,858 and U.S. Pat. No. 4,988,333 it is also previously known to install a part of the hearing aid device on the middle ear bones. Although such a solution leaves the auditory meatus free, it nevertheless requires an extensive surgical installation procedure on the middle ear bones. These types of hearing aids have therefore not been used so much.

However, there are other types of sound transmitting hearing aids on the market, i e bone anchored hearing aids which mechanically transmit the sound information to a persons inner ear via the skull bone by means of a vibrator. The hearing aid device is connected to an implanted titanium screw installed in the bone behind the ear and the sound is transmitted via the skull bone to the cochlea (inner ear), i e the hearing aid works whether there is a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a bayonet coupling or a snap in coupling. One example of this type of hearing aid device is described in U.S. Pat. No. 4,498,461 and it is also referred to the BAHA® bone anchored hearing aid marketed by Entific Medical Systems in Göteborg.

Even if the bone conduction hearing aid devices have made it possible for more people to benefit from a satisfactory hearing aid, there are also problems with this type of hearing aid devices. One problem is the permanent skin penetration which requires a good hygienic control and has aesthetic limits. By implanting parts of the apparatus hygienic as well as cosmetic aspects can be improved. Such a device is described in U.S. Pat. No. 4,904,233. A similar implantable bone anchored apparatus is also described in "Hearing by Bone Conduction", Stefan Stenfelt, Chalmers University of Technology, 1999. It is also referred to our co-pending patent application PCT/SE01/01229 which relates to a hearing aid device which comprises an external part as well as an implantable part which is anchored on the outside of the skull bone so that it can be easily replaced without any advanced surgical operation.

A common feature for the hearing aid devices which have been described here is that vibratory generating means, vibrators, are required. Different types of vibrators are well known in the art. There are a number of known vibrator principles today in traditional as well as in bone anchored hearing aid devices it is normally used a vibrator principle which was described by Bell already in 1876. There is a detailed description of this principle applied on a bone anchored hearing aid device in "on Direct Bane Conduction Hearing Devices", Technical Report No. 195, Department of Applied Electronics, Chalmers University of Technology, 1990.

It is also referred to Swedish Patent No. 85.02426-3 which describes a vibrator having means for damping the natural frequency of the vibrator.

In headphones for air conduction hearing aids any type of the so-called "Balanced Armature" principle is often used, see for instance U.S. Pat. No. 905,781, Baldwin 1908. Even the so-called Moving coil principle, known from conventional loud-speakers, could be used.

For vibrators used for bone conduction hearing aid devices there are specific requirements. The vibrators should be powerful enough for transmitting the vibrations to the skull bone and forward the vibrations through the skull bone to the inner ear without any surgical operation in the bone. If a part of the hearing aid device is implantable onto the skull bone the vibrator should be as small and compact as possible.

The existing vibrator types like Bell, Balanced armature, Floating mass and Moving coil principles can be used also in this type of implantable bone conduction hearing aid devices, but they do not always give an optimal function for this specific application.

SUMMARY OF THE INVENTION

It is an object of the present invention to provide a vibrator device which is powerful enough, but at the same time has a small energy consumption and has small dimensions. The vibrator device is based on the principle that the dynamic field does not need to pass through the permanent magnets in the vibrator while the static magnetic field passes through substantially all of the magnetic circuit which requires a high material thickness.

The invention is mainly characterized by a two-piece coil and a central permanent magnet located between the two coil pieces so that the static and dynamic magnetic fields are cooperating in the magnetic circuit, while the dynamic field does not pass through the permanent magnet, in order to provide the vibrator with an axial force generation.

According to a preferred embodiment the magnetic circuit is formed as a casing around the vibrator device which casing protects the vibrator and reduces magnetic leakage.

BRIEF DESCRIPTION OF THE DRAWINGS

In the following the invention will be described more in detail with reference to the accompanying drawings, in which.

DETAILED DESCRIPTION OF EMBODIMENTS OF THE INVENTION

Figure 1:
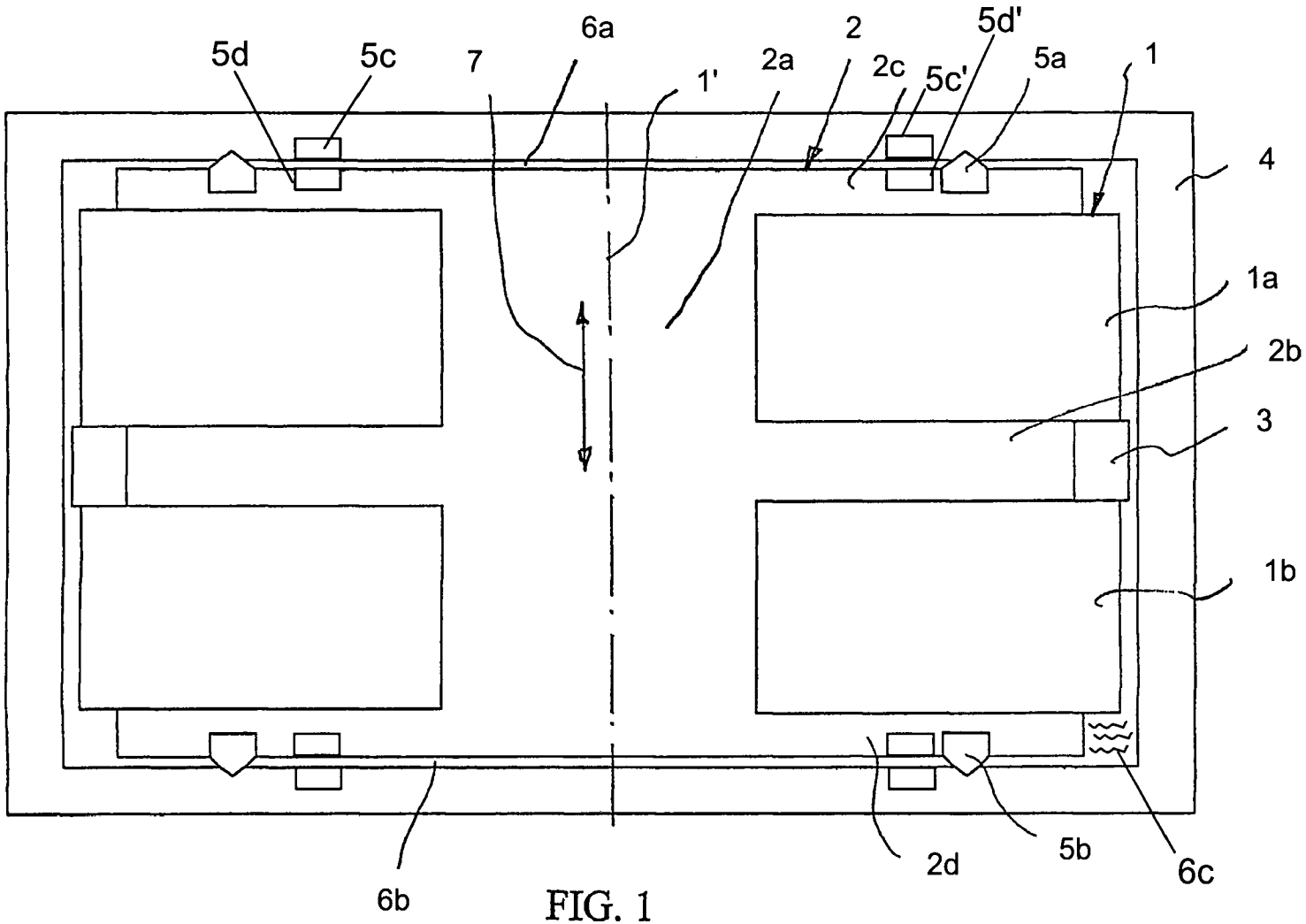
FIG. 1 is a cross-sectional view of a first embodiment of the vibrator.

As all of the embodiments of the vibrator are symmetrical only one half of each vibrator device is shown in the figures, except from FIG. 1. FIG. 1 shows a cross-section through the centre axis 1' of a first embodiment of the vibrator. The vibrator comprises a coil 1 which is wound around a bobbin base 2 with a core 2*a* and two side walls 2*c*, 2*d*. The coil is divided into two halves 1*a*, 1*b* with an intermediate central wall 2*b* in the bobbin. An annular permanent magnet 3 is arranged on the end surface of the central wall 2*b*. The entire coil and magnet arrangement is housed in a casing 4 which forms a part of the magnetic circuit and protects the vibrator and reduces magnetic leakage. The bobbin base and the casing are made of a material with high magnetic conductivity. Inner spring mechanisms 4*a*, 5*b* are arranged between the side walls of the bobbin base and the casing so that the coil and magnet arrangement is centered in the casing in its rest position with two air gaps 6*a*, 6*b* of the same size between the side walls and the casing. It is not necessary that the spring mechanisms are preloaded. In order to damp the vibratory movements of the coil arrangement the inner spacing of the vibrator can be filled with a suitable liquid 6*c*.

Instead of mechanically arranged spring mechanisms the vibrator coil could be centered magnetically by means of annular, repelling magnets 5*c*, 5*d*, 5*c* arranged on the outer side of the bobbin wall and opposite side of the casing.

Figure 2:
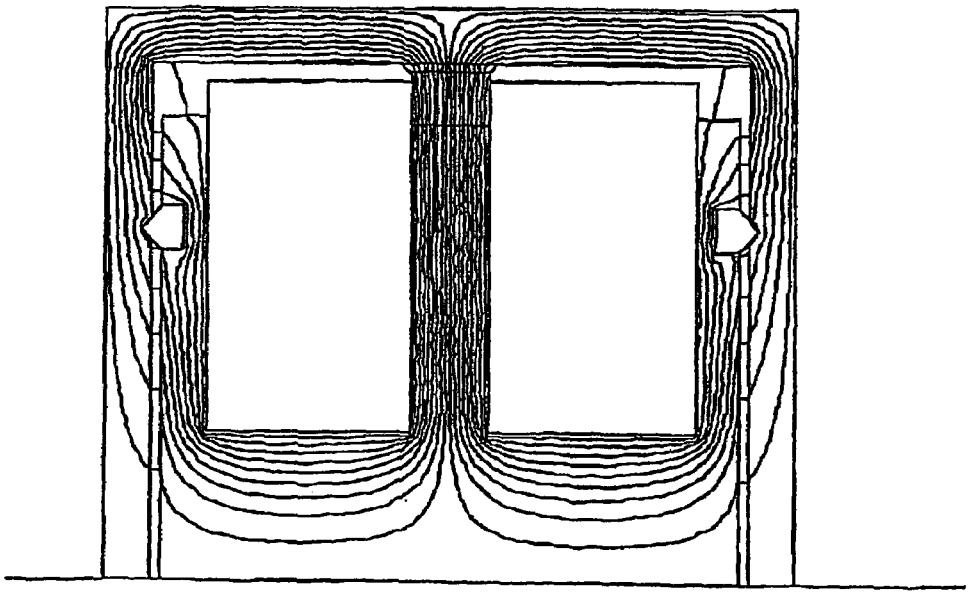
FIG. 2 shows the static magnetic field of the vibrator.

The centrally located permanent magnet 3 generates a static magnetic field which is illustrated in FIG. 2. As shown in the figure the magnetic field is passing through the entire construction/magnetic circuit.

Figure 3:
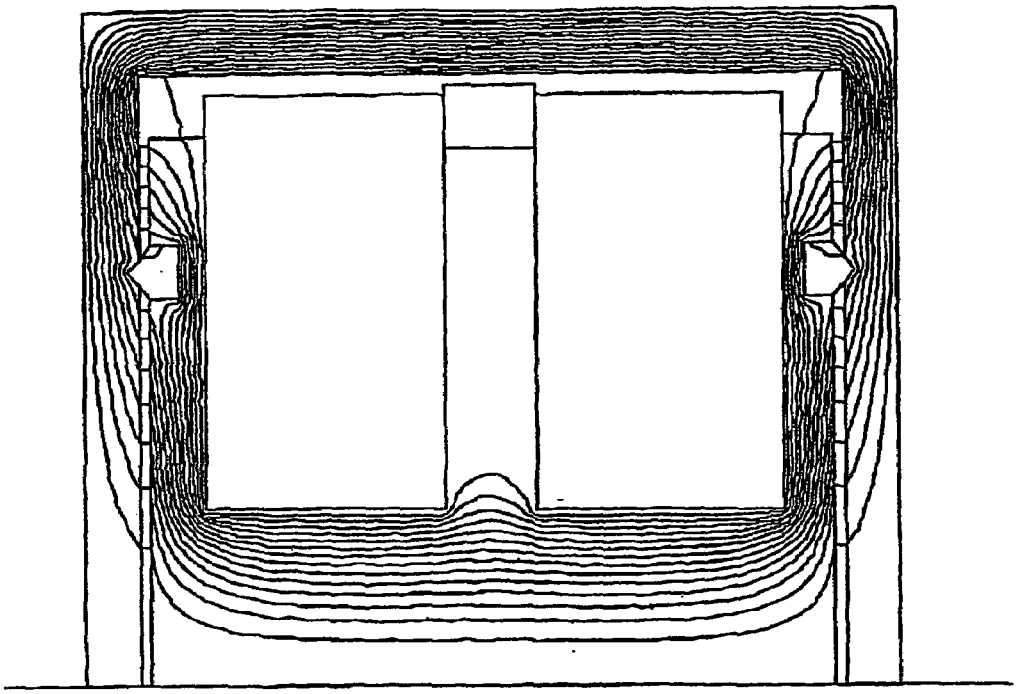
FIG. 3 shows the dynamic magnetic field of the vibrator.

When an alternating current is passing through the coil halves 1*a*, 1*b* a dynamic magnetic field is generated as illustrated in FIG. 3. As shown in the figure the entire construction/magnetic circuit is passed through by the dynamic magnetic field, except from the central wall 2*d* of the bobbin with the permanent magnet 3. The force is generated in the air gaps 6*a*, 6*b* between the bobbin and the casing when a current flows through the coil. As already mentioned, in the rest position the air gaps have the same size; no static force is acting and the inner spring mechanism does not need to be pre-loaded. In operation the coil 1, the bobbin 2 and the annular magnet 3, i e the entire coil and magnet assembly, is moved relative to the casing so that an axial force is obtained as indicated by the arrow 7 in the figure. The inner spring mechanism 5*a*, 5*b* is chosen in such a way that a satisfacory resonant frequency is obtained from an audiological and effectiveness point of view.

Figure 4:
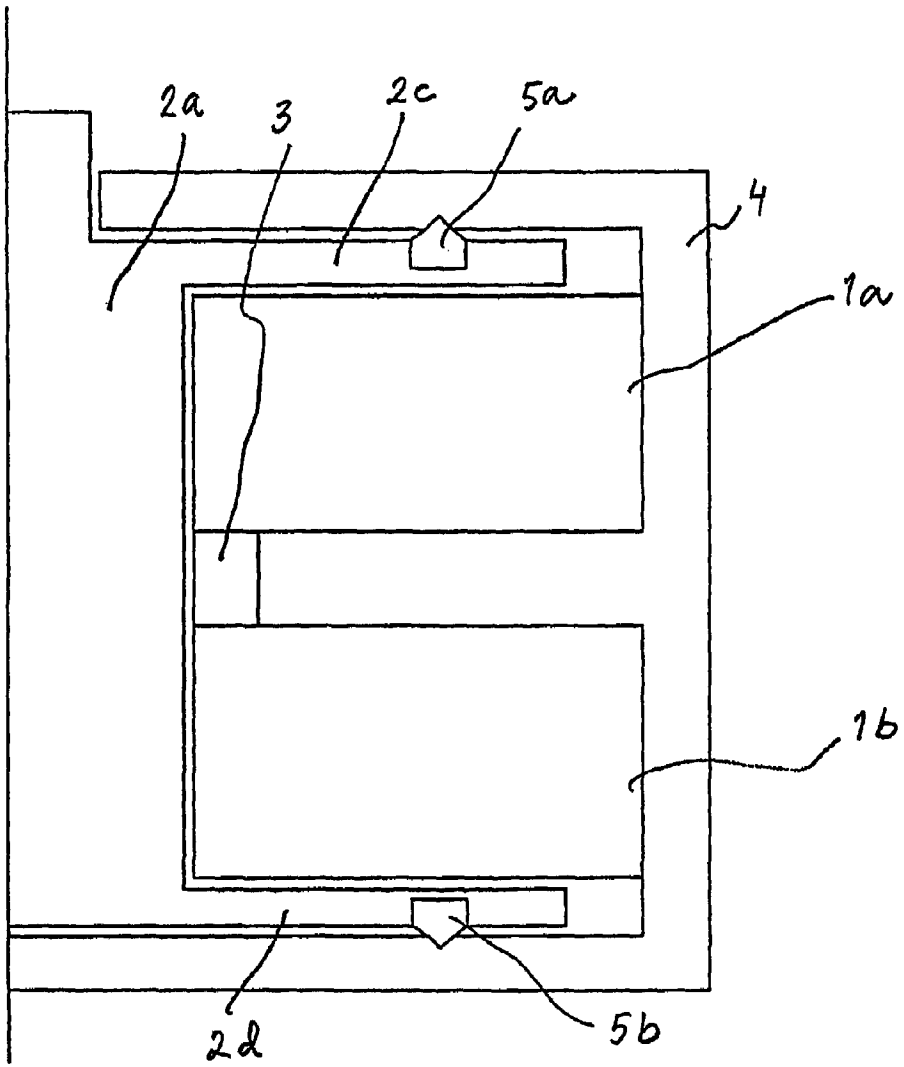
FIG. 4 shows a second embodiment in which the permanent magnet and the coil are attached to the casing.
Figure 6:
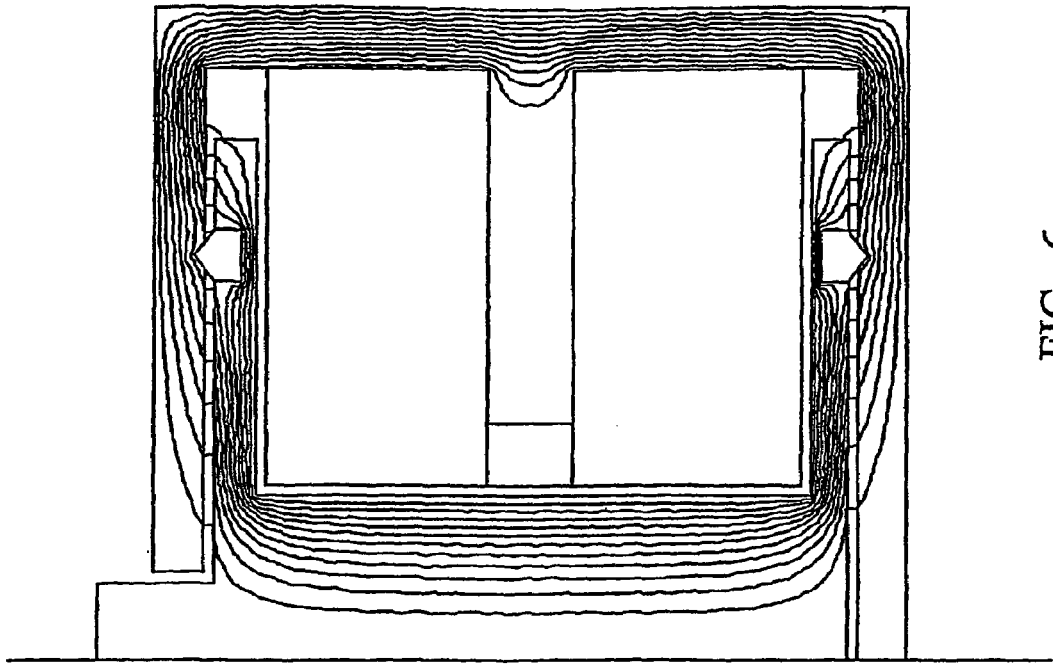
FIG. 6 shows the dynamic field of this second embodiment.
Figure 5:
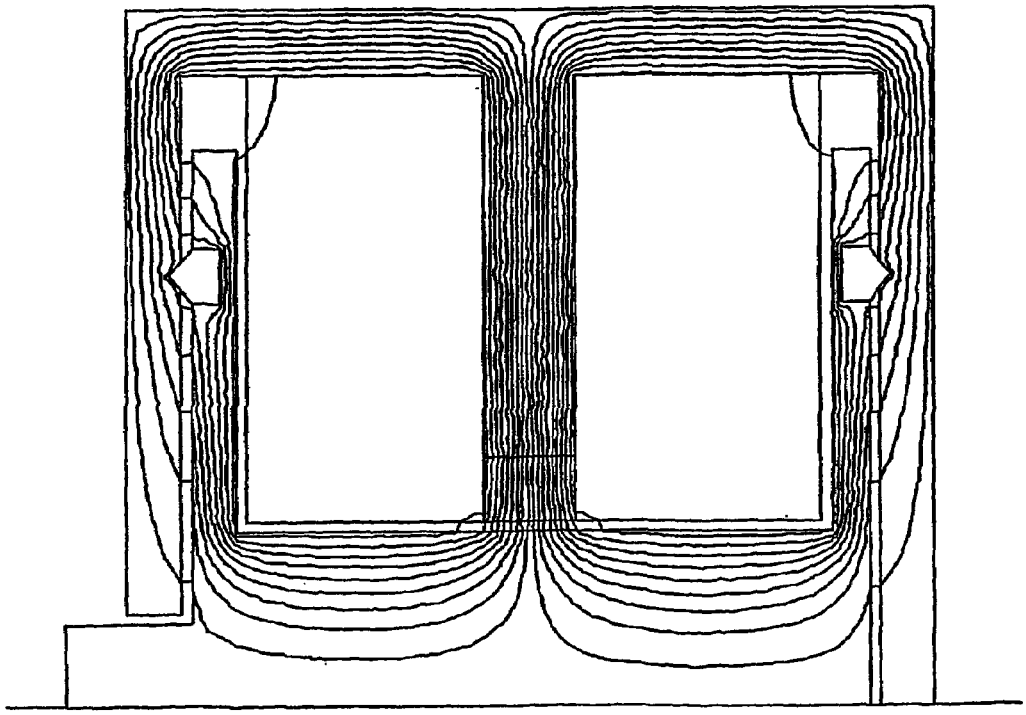
FIG. 5 shows the static magnetic field of the vibrator.

In FIG. 4 another example of a vibrator design is illustrated in which the annular permanent magnet 3 and the coil halves 1*a*, 1*b* instead are attached to the casing 4. The vibrator force is obtained through the bobbin 2 which is allowed to project out from the casing. Similar to the first embodiment the annular permanent magnet is working so that a static magnetic field according to FIG. 5 is generated. When an alternating current is passing through the coil halves 1, 1*b* a dynamic field is generated as illustrated in FIG. 6. The static and the dynamic magnetic fields are cooperating also in this case and provides the vibrator with an axial force direction.

It should be understood that there might be hybrids between these two design solutions so that each of the coil and annular magnets are attached to either the bobbin or casing.

As mentioned by way of introduction the vibrator is specifically intended to be used in connection with a bone conduction hearing aid device. In case of conventional bone conduction the casing 4 of the vibrator is resting directly against the skull of the patient. In case of a bone anchored bone conduction hearing aid coupling means are arranged on the casing for connection to an implant, for instance a titanium screw, a so-called fixture, anchored in the skull bone. In case of an implanted bone conductor the vibrator is used with or without coupling means depending on the implant method.

The invention is not limited to the embodiments illustrated in the figures but can be varied within the scope of the accompanying patent claims.

What is claimed is:

1. A vibrator for bone conduction type hearing aid devices in which sound information is mechanically transmitted via the skull bone directly to the inner ear of a person with impaired hearing, the vibrator comprising:

a two-piece coil operative to generate a dynamic magnetic field;

an intermediate central wall between the two coil pieces; and an annular permanent magnet operative to generate a static magnetic field in a magnetic circuit, the permanent magnet being located on the central wall between the two coil pieces, such that the static magnetic field and dynamic magnetic field cooperate in the magnetic circuit, while the dynamic field does not pass through the permanent magnet, in order to provide the vibrator with an axial force generation.

2. The vibrator according to claim 1, further comprising:

a casing operative to enclose the two-piece coil, central wall and permanent magnet, the casing forming a part of the magnetic circuit, protecting the vibrator and reducing magnetic leakage.

3. The vibrator according to claim 2, further comprising:

air gaps between the two-piece coil and the permanent magnet and the casing, the static magnetic field and dynamic magnetic field coinciding in the air gaps.

4. The vibrator according to claim 3, further comprising:

inner spring means arranged between the two-piece coil and the permanent magnet and the casing such that the two-piece coil and permanent magnet in a rest position are centered in the casing between two air gaps of the same size.

5. The vibrator according to claim 3, further comprising:

repellent magnets arranged in the opposite parts of the casing such that the two-piece coil and permanent magnet in a rest position are centered in the casing between two air gaps of the same size.

6. The vibrator according to claim 3, further comprising:

a liquid filling the air gaps and being operative to damp vibratory movements of the two-piece coil and permanent magnet.

7. The vibrator according to claim 2, further comprising:

a bobbin base around which the two coil pieces are wound, wherein the bobbin protrudes through the casing, wherein the two-piece coil and the permanent magnet are attached to the casing, and wherein an axial force from the vibrator is obtained through the coil bobbin.

8. The vibrator according to claim 3, further comprising:

a bobbin base around which the two coil pieces are wound, the bobbin base comprising a core, the intermediate wall and two side walls, wherein the permanent magnet is arranged on an end surface of the intermediate wall.

9. The vibrator according to claim 8, wherein the permanent magnet is axially magnetized.

10. The vibrator according to claim 1, wherein the magnetic circuit is arranged such that the dynamic magnetic field does not pass through the permanent magnet.

11. A bone conduction hearing aid device, comprising:

an external part comprising a microphone and electronic circuitry;

an internal, implantable part to be anchored subcutaneously into the skull bone; and a vibrator arranged in the implantable part, the vibrator comprising a two-piece coil operative to generate a dynamic magnetic field, an intermediate central wall between the two coil pieces, and an annular permanent magnet operative to generate a static magnetic field in a magnetic circuit, wherein the permanent magnet is located on the central wall between the two coil pieces, such that the static magnetic field and dynamic magnetic field cooperate in the magnetic circuit, while the dynamic field does not pass through the permanent magnet, in order to provide the vibrator with an axial force generation.

12. The bone conduction hearing aid device according to claim 11, wherein energy required for the vibrator is provided by induction.

13. The bone conduction hearing aid device according to claim 11, further comprising:

a rechargeable battery arranged in the implantable part of the vibrator and providing energy required for the vibrator.

14. The bone conduction hearing aid device according to claim 11, further comprising:

an osseointegrating part included in the implantable part, wherein the vibrator is directly connected to the osseointegrating part.

* * * * *